US006094001A

United States Patent [19]

Xie

[11] Patent Number: 6,094,001

[45] Date of Patent: Jul. 25, 2000

[54] FIELD EMISSION DEVICE HAVING A FOCUSING STRUCTURE AND METHOD OF FABRICATION

[75] Inventor: Chenggang Xie, Phoenix, Ariz.

[73] Assignee: Motorola, Inc., Schaumburg, Ill.

[21] Appl. No.: 09/111,503

[22] Filed: Jul. 7, 1998

[51] Int. Cl.[7] ..... H01J 1/02

[52] U.S. Cl. ..... 313/309; 313/336; 313/351; 313/451; 313/310

[58] Field of Search ..... 313/309, 336, 313/351, 445, 310

[56] References Cited

U.S. PATENT DOCUMENTS 4,874,981 10/1989 Spindt .
5,278,472 1/1994 Smith et al. .
5,451,175 9/1995 Smith et al. .

*Primary Examiner*—Vip Patel
*Attorney, Agent, or Firm*—Jasper W. Dockrey; Keven D. Wills

[57] ABSTRACT

A field emission device (400) includes a substrate (414), a cathode (415) disposed on substrate (414), a dielectric layer (418) disposed on cathode (415) and defining an emitter well (421) and further defining a focusing well (448), an electron emitter (420) disposed within emitter well (421) and connected to cathode (415), a gate electrode (422) disposed on dielectric layer (418), and a focusing structure (450) disposed within focusing well (448) and connected to cathode (415) for focusing an electron beam (430) emitted by electron emitter (420). A method for fabricating field emission device (400) includes directing a second collimated vapor beam (461) toward focusing well (448) subsequent to forming an encapsulating layer (478) over emitter well (421), thereby forming focusing structure (450).

28 Claims, 4 Drawing Sheets

-PRIOR ART-

-PRIOR ART-

-PRIOR ART-

FIELD EMISSION DEVICE HAVING A FOCUSING STRUCTURE AND METHOD OF FABRICATION

FIELD OF THE INVENTION

The present invention pertains to the area of field emission devices (FEDs) and, more particularly, to FEDs having capabilities for focusing electron beams.

BACKGROUND OF THE INVENTION

A commonly encountered objective in the operation of FEDs, such as field emission displays, is control of the spot size of an electron beam. With respect to the operation of a field emission display, a controlled spot size provides improved resolution, brightness, and, for a color display, improved color purity.

FIG.1 illustrates, in cross-section, a prior art FED 100 having a planar focusing electrode 128 for controlling the spot size of an electron beam 130. FED 100 includes a cathode plate 110 and an anode plate 111, which opposes cathode plate 110.

Cathode plate 110 has a substrate 114. First, second, and third cathodes 115, 116, 117 are disposed upon substrate 114. A first dielectric layer 118 is formed upon cathodes 115, 116, 117 and includes a plurality of emitter wells 121. In each of emitter wells 121 is formed an electron emitter 120. Cathode plate 110 further includes a gate electrode 125 disposed upon first dielectric layer 118 and circumscribing each of emitter wells 121. A second dielectric layer 126 is disposed upon gate electrode 125. A focusing electrode is disposed upon second dielectric layer 126.

Anode plate 111 includes a transparent substrate 113, upon which is formed an anode 112. A red phosphor 132, a green phosphor 134, and a blue phosphor 136 are disposed upon anode 112. Electron emitters 120 that are connected to first cathode 115 oppose red phosphor 132; electron emitters 120 that are connected to second cathode 116 oppose green phosphor 134; electron emitters 120 that are connected to third cathode 117 oppose blue phosphor 136.

FED 100 is operated by applying potentials at first, second, and third cathodes 115, 116, 117 and to gate electrode 125 for causing selective emission from electron emitters 120. A potential is also applied to planar focusing electrode 128. The potential at planar focusing electrode 128 is selected to collimate electron beam 130 and to result in a controlled spot size at red, green, and blue phosphors 132, 134, 136.

Prior art FED 100 requires additional processing steps to form second dielectric layer 126 and planar focusing electrode 128. It would be desirable to reduce the number of processing steps in the fabrication of an FED, while retaining the control over the spot size of the electron beams.

FIG. 2 is a cross-sectional view of another prior art FED 200, which has multiple, selectively addressable anodes. Elements of FED 200 that are the same as those of FED 100 are similarly referenced, beginning with a "2". In contrast to FED 100, which has a single-anode configuration, FED 200 has a first anode 212, a second anode 238, and a third anode 240 within each pixel. A red phosphor 232 is connected to first anode 212; a green phosphor 234 is connected to second anode 238; and a blue phosphor 236 is connected to third anode 240.

Each pixel of FED 200 has one cathode. The cathode is used to cause emission from a plurality of electron emitters 220, which are in the given pixel. Illustrated in FIG. 2 is a first pixel 242 having a first cathode 216. Further illustrated is a portion of a second pixel 244 having a second cathode 217.

All of electron emitters 220 of a given pixel are caused to emit regardless of which of phosphors 232, 234, 236 are to be activated. Color selectivity is achieved by selectively addressing first, second, and/or third anodes 212, 238, 240. An electron beam 230 from each of electron emitters 220 is attracted toward the selected phosphor(s) by applying an attracting potential to the anode(s) connected thereto. In this manner, electron emitters 220, which do not directly oppose the selected phosphor, are also utilized to activate the selected phosphor.

A shortcoming of prior art FED 200 is that portions of electron beams 230 can be attracted toward phosphors of adjacent pixels. As show in FIG. 2, electrons from electron beam 230, which are intended to be directed toward green phosphor 234, can undesirably be diverted toward red phosphor 232 of an adjacent pixel, if first anode 212 of the adjacent pixel is simultaneously addressed. This phenomenon results is the loss of color purity for FED 200.

A further shortcoming of FED 200 is that the multiple anode configuration is not practical for operation at high anode voltages, such as, for example, greater than about 600 volts. This is due to the greater power requirements for switching at high voltages and the increased risk of electrical arcing between the anodes. It would be desirable, therefore, to provide improved color purity of an FED, while simultaneously avoiding switching a high anode voltage.

FIG. 3 is a cross-sectional view of yet another prior art FED 300 having a phosphor area, $A_P$, that is greater than an emitter area, $A_E$. Elements of FED 300 that are the same as those of FED 100 are similarly referenced, beginning with a "3". FIG. 3 depicts a sub-pixel of FED 300. A plurality of electron emitters 320 oppose a red phosphor 332. In the operation of FED 300, no attempt is made to focus an electron beam 330 subsequent to its emission from one of electron emitters 320. Thus, a spot size, S, of electron beam 330 at red phosphor 332 is relatively large. In order to confine electron beam 330 to receipt at red phosphor 332, emitter area, $A_E$, is made smaller than phosphor area, $A_P$.

FED 300 suffers from the drawback of a limited emitter area. A reduced emitter area can reduce the overall current for stimulating the phosphor and thus reduces the brightness. An increased phosphor area are can result in poor resolution for FED 300.

Accordingly, there exists a need for an improved FED having a focusing capability that simplifies the fabrication of FEDs and that further improves brightness, color purity, and resolution over the prior art.

Figure 1:
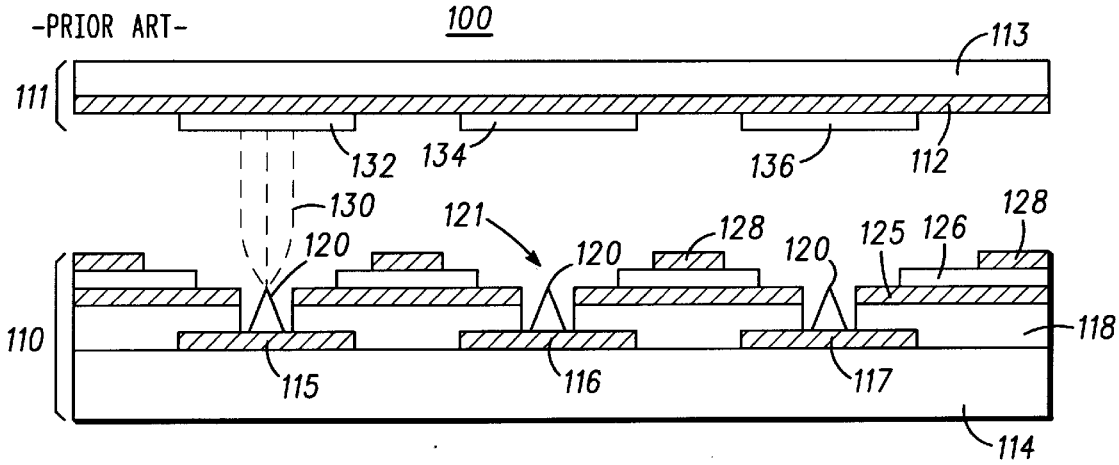
FIG. 1 is a cross-sectional view of a prior art field emission device having a planar focusing electrode.
Figure 2:
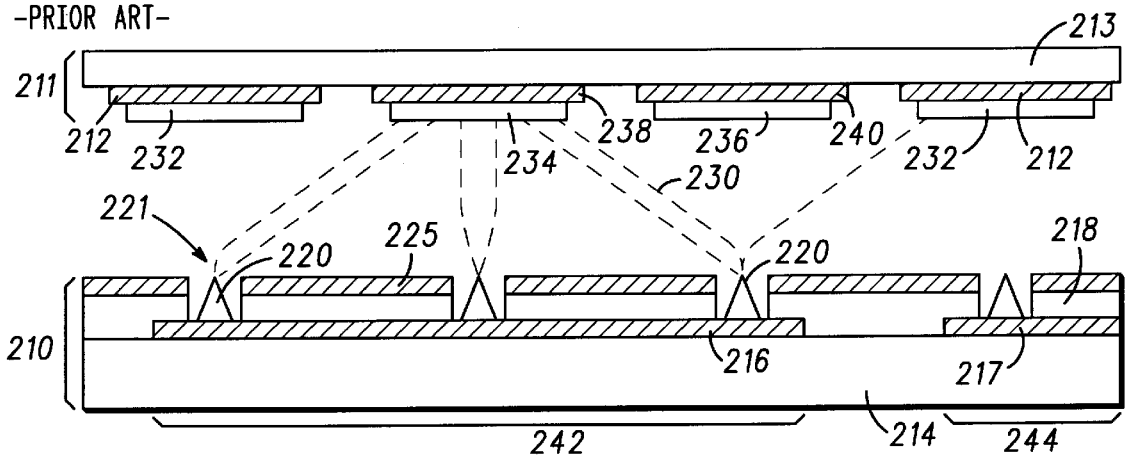
FIG. 2 is a cross-sectional view of another prior art field emission device having multiple anodes.
Figure 3:
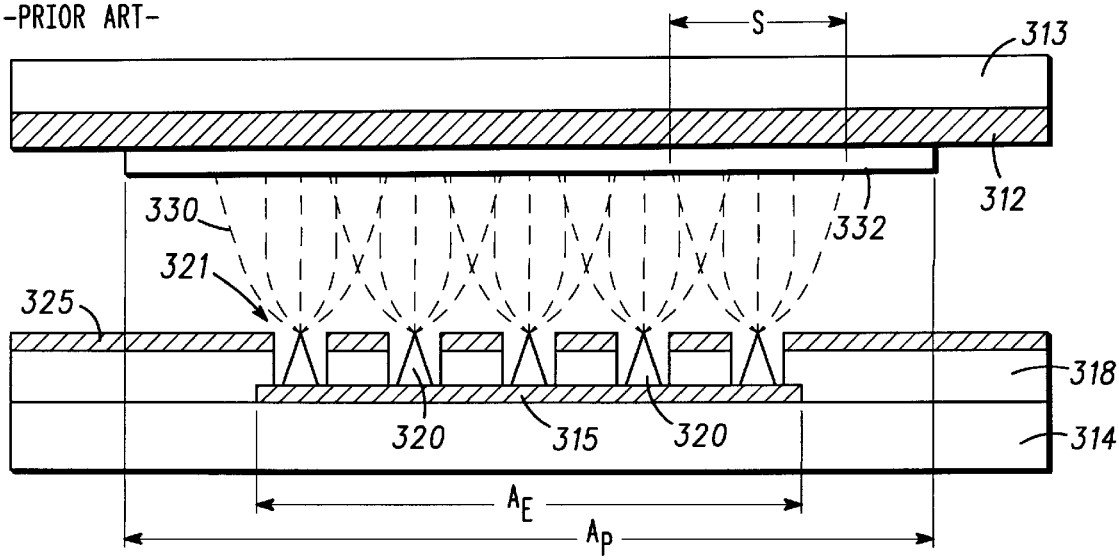
FIG. 3 is a cross-sectional view of yet another prior art field emission device having a phosphor area that is greater than an emitter area.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for an FED having a focusing structure disposed within a focusing well adjacent to an electron emitter. A gate electrode circumscribes the electron emitter and is spaced apart from the focusing well. The focusing structure is preferably generally conically-shaped and is preferably made from the material of the electron emitter. The focusing structure extends from the bottom of the focusing well to a distance above the electron emitter.

The focusing structure of the invention is made during the step for making the electron emitter. Thus, its manufacture preferably does not necessitate additional process steps. Furthermore, the focusing structure of the invention can be used to enhance color purity in a color field emission display. The focusing structure of the invention provides electron beam focusing for use with a single-anode FED configuration. In this manner, high voltage anode operation is facilitated. Furthermore, the focusing structure of the invention increases the ratio of emitter area to phosphor area, which can improve brightness.

Figure 4:
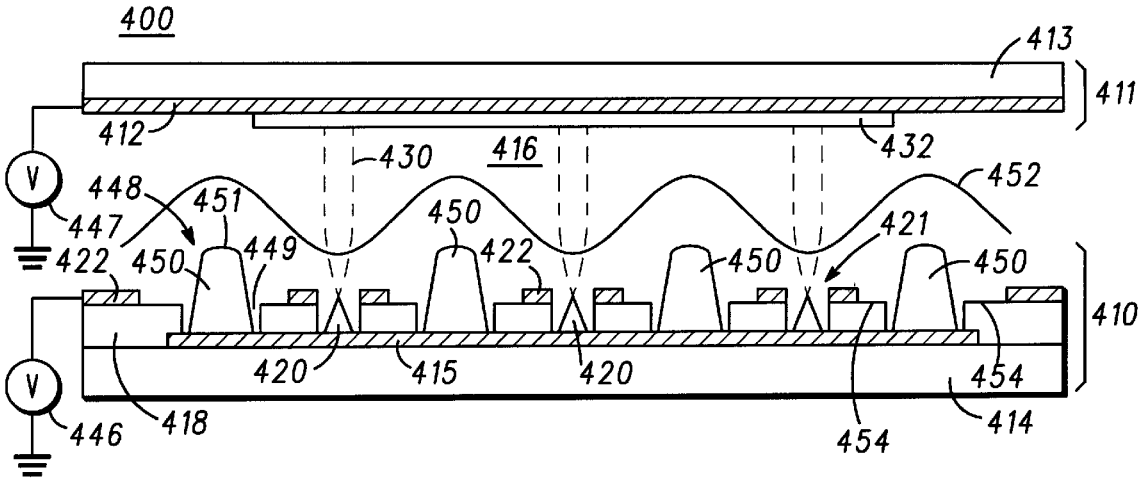
FIG. 4 is a cross-sectional view of a field emission device in accordance with the preferred embodiment of the invention.

FIG. 4 illustrates, in cross-section, an FED 400 in accordance with a preferred embodiment of the invention. FED 400 is a polychromatic field emission display and includes a cathode plate 410 and an anode plate 411. Anode plate 411 is spaced apart from cathode plate 410 to define an interspace region 416. Interspace region 416 has a pressure of less than about $1.33\times10^{-4}$ Pascal.

Anode plate 411 includes a transparent substrate 413, upon which is formed an anode 412. A plurality of phosphors are disposed on anode 412. For ease of understanding, only one phosphor, a red phosphor 432, is illustrated in FIG. 4.

Cathode plate 410 includes a substrate 414, which can be made from glass, quart, silicon, and the like. A cathode 415 is disposed on substrate 414. Cathode 415 is made from a conductive material, such as molybdenum, aluminum, and the like. Cathode 415 is formed using a convenient deposition method. Cathode plate 410 further includes a dielectric layer 418, which is disposed on cathode 415. Dielectric layer 418 is made from a dielectric material, such as silicon dioxide, silicon nitride, and the like. Dielectric layer 418 is formed using a convenient deposition method.

Dielectric layer 418 defines two types of well structures. The first type of well structure is an emitter well 421; the second type of well structure is a focusing well 448. The size of the opening of focusing well 448 is greater than the size of the opening of emitter well 421.

Preferably, the opening of focusing well 448 is at least 50% larger than the opening of emitter well 421. In the embodiment of FIG. 4, each of focusing wells 448 and emitter wells 421 have a circular cross-section. Thus, the diameter of the opening of focusing well 448 is greater than the diameter of emitter well 421. An exemplary configuration includes dielectric layer 418 having a thickness of 1 micrometer, emitter well 421 having a diameter of 1 micrometer, and focusing well 448 having a diameter within a range of 1.5–2 micrometers.

Preferably, the separation distance between adjacent well structures, regardless of type, is uniform over cathode plate 410. However, the distance between each of focusing wells 448 and well structures adjacent to it can be adjusted to provide the desired focusing effect.

Disposed within emitter well 421 is an electron emitter 420. Electron emitter 420 is preferably a tip, such as the electron-emitting tip known as a Spindt tip. Electron emitter 420 is made from an emissive material, such as molybdenum, silicon, and the like.

Cathode plate 410 further includes a gate electrode 422, which is disposed on dielectric layer 418 proximate to emitter wells 421. Gate electrode 422 is useful for causing electron emission from electron emitter 420. Gate electrode 422 in the embodiment of FIG. 4 is planar and circumscribes emitter wells 421.

However, field emission devices embodying the invention are not limited to planar gate electrodes. In general, the configuration of the gate electrode is selected to provide an extraction field at the electron emitters for causing electron emission. Further in accordance with the invention, the configuration of the focusing well and the focusing structure with respect to the gate electrode is selected to provide the desired focusing effect.

Disposed within each of focusing wells 448 is a focusing structure 450. Focusing structure 450 is made, at least in part, from the emissive material of electron emitter 420. However, the scope of the invention is not limited by this embodiment. For example, it is desired to be understood that a focusing structure embodying the invention can include a plurality of layers, each of which is made from a material that is distinct from the layer(s) adjacent to it.

As a result of the method by which it is made and due to the circular cross-section of focusing well 448, focusing structure 450 is generally conically-shaped and further defines, together with dielectric layer 418, a gap 449 within focusing well 448. Focusing structure 450 has an apex 451. Preferably, apex 451 has few or no sharp geometric features, such as sharp points and edges, so that spurious emission can be ameliorated. For example, apex 451 can be rounded.

Focusing structure 450 also extends a distance above electron emitter 420. This distance is selected to achieve a desired focusing effect. Preferably, this distance is equal to at least 0.5 micrometers. In the embodiment of FIG. 4, focusing structure 450 also extends a distance 445 above a plane defined by gate electrode 422. Preferably, distance 445 is equal to at least 0.5 micrometers. Most preferably, distance 445 is within a range of 0.5–5 micrometers.

In the preferred embodiment, and as illustrated in FIG. 4, focusing structures 450 are located among electron emitters 420. For this configuration, when employed in a display device, the focusing structures associated with a given pixel (monochromatic display) or sub-pixel (polychromatic display) are connected to the cathode associated with the given pixel or sub-pixel. Because the cathode is operated at a voltage that is lower than the voltage at the gate electrode, connection of the focusing structures to the cathode provides a voltage at the focusing structures that is lower than the voltage at the gate electrode.

The provision of a potential at the focusing structures, which is lower than the potential at the gate electrode, can be achieved through configurations distinct from that shown in FIG. 4 and in accordance with the invention. For example, the focusing structures can be connected to an additional electrode, the potential at which can be independently controlled from that at the cathode.

FIG. 4 illustrates a configuration in which one focusing structure is provided between adjacent electron emitters. However, other configurations of focusing structures and electron emitters can embody the invention. For example, more than one focusing structure can be provided between adjacent electron emitters. Another example is a configuration in which at least one focusing structure is disposed between selected pairs of adjacent electron emitters, such that no focusing structure is provided between the unselected pairs of adjacent electron emitters.

Preferably, gate electrode 422 is spaced apart from focusing well 448 to define a dielectric surface 454 between them. The separation distance between gate electrode 422 and each of focusing wells 448 is selected to reduce spurious electron emission from focusing structures 450.

During the operation of FED 400, a first potential source 446 is connected to gate electrode 422; a second potential source 447 is connected to anode 412; and a third potential source (not shown) is connected to cathode 415. A first potential is applied at cathode 415, and a second potential is applied at gate electrode 422 for causing electron emission from electron emitters 420. A third potential is provided at anode 412 for attracting an electron beam 430 toward anode 412. The third potential is greater than the second potential, which is greater than the first potential. Accordingly, because focusing structures 450 are connected to cathode 415 and because focusing structures 450 extend above gate electrode 422 as shown, a focusing electric field is realized within interspace region 416 during the operation of FED 400. The focusing electric field is partially represented by a focusing equipotential line 452 in FIG. 4. The focusing electric field is useful for focusing electron beams 430.

Figure 5:
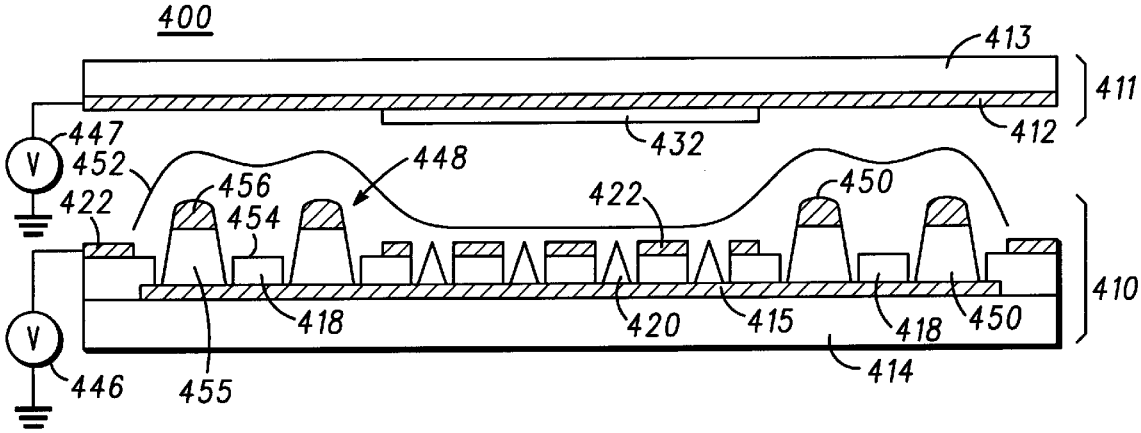
FIG. 5 is a cross-sectional view of a field emission device in accordance with another embodiment of the invention.

FIG. 5 is a cross-sectional view of FED 400 in accordance with another embodiment of the invention. In the embodiment of FIG. 5, focusing structures 450 are positioned, two deep, at the periphery of a sub-pixel defined by electron emitters 420. Focusing equipotential line 452 in FIG. 5 illustrates that the focusing effect occurs primarily at the periphery of the sub-pixel. By providing a focusing region that has a width defined by two focusing structures 450, the electron focusing is more effective than a focusing region that has a width defined by one focusing structure 450.

Further illustrated in FIG. 5 is dielectric surface 454, which is defined by dielectric layer 418 between adjacent focusing structures 450. Gate electrode 422 is preferably not provided between adjacent focusing structures 450 so that spurious emission from focusing structures 450 can be ameliorated.

The embodiment of FIG. 5 is further characterized by each of focusing structures 450 having a first layer 455 and a second layer 456, which is formed on first layer 455. A focusing structure embodying the invention is not limited to one or two layers and can include, for example, three or more distinct layers.

In the embodiment of FIG. 5, first layer 455 is made from the emissive material of electron emitter 420 and is at least partially disposed within focusing well 448. (The first layer can be fully disposed within the focusing well if, for example, the depth of the focusing well is made greater than the depth of the emitter well.) Second layer 456 is made from a second material, which is preferably less emissive than the emissive material of electron emitters 420. In this manner, spurious electron emission from focusing structures 450 is further ameliorated. For example, first layer 455 and electron emitters 420 can be made from molybdenum, and second layer 456 can be made from aluminum.

Figure 6:
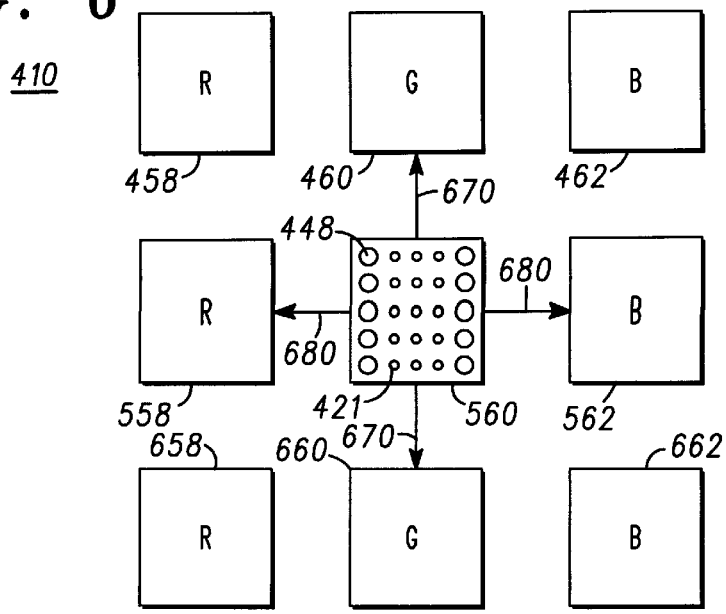
FIG. 6 is a top plan, schematic view of a cathode plate of a field emission device in accordance with yet another embodiment of the invention.

FIG. 6 is a top plan, schematic view of cathode plate 410 of a field emission device in accordance with yet another embodiment of the invention. Illustrated in FIG. 6 is one of many potential configurations of emitter wells 421 and focusing wells 448 within a sub-pixel or pixel. Also illustrated in FIG. 6 are the configurations of emitter wells 421 and focusing wells 448 of one sub-pixel with respect to adjacent sub-pixels. The embodiment of FIG. 6 achieves focusing at the sub-pixel level.

For ease of understanding, FIG. 6 illustrates three pixels, each of which has three sub-pixels. The first pixel has a red sub-pixel 458, a green sub-pixel 460, and a blue sub-pixel 462, which are indicated by the letters "R", "G", and "B", respectively, in FIG. 6. The second pixel has a red sub-pixel 558, a green sub-pixel 560, and a blue sub-pixel 562. The third pixel has a red sub-pixel 658, a green sub-pixel 660, and a blue sub-pixel 662.

It is desired to mitigate the migration of electrons, which are emitted from any given sub-pixel, toward the phosphors (not shown) corresponding to the neighboring sub-pixels, which are adjacent to the given sub-pixel. The directions of this migration are specifically indicated in FIG. 6 for green sub-pixel 560 and are represented by arrows 670 and arrows 680.

In the embodiment of FIG. 6, the distance between adjacent sub-pixels of the same pixel is less than the distance between adjacent sub-pixels of adjacent pixels. Furthermore, the distance between adjacent sub-pixels of a given pixel (e.g., green sub-pixel 560 and blue sub-pixel 562) is insufficient to prevent, absent focusing structures 450 between the sub-pixels, intra-pixel color bleeding. However, the distance between adjacent sub-pixels of adjacent pixels (e.g., green sub-pixel 460 and green sub-pixel 560) is sufficiently large, so that focusing structures 450 are not required between them to prevent inter-pixel color bleeding. Thus, in the embodiment of FIG. 6, color bleeding is reduced by providing focusing structures 450 between adjacent sub-pixels of each pixel. The embodiment of FIG. 6 provides the benefit of a low total area occupied by focusing wells 448 on cathode plate 410.

Figure 7:
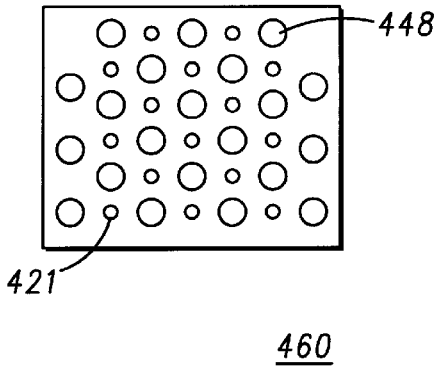
FIG. 7 is a top plan, schematic view of a sub-pixel of a cathode plate of a field emission device in accordance with a further embodiment of the invention.

FIG. 7 is a top plan, schematic view of green sub-pixel 460 of a cathode plate of a field emission device in accordance with a further embodiment of the invention. The embodiment of FIG. 7 achieves focusing at the electron emitter level. In the embodiment of FIG. 7, focusing wells 448 are configured such that each of emitter wells 421 is surrounded by four focusing wells. The embodiment of FIG. 7 provides the benefit of focusing the electron beam from each of electron emitters 420 (not shown).

FIGS. 8–11 are cross-sectional views of cathode plate 410 of a field emission device fabricated in accordance with the method of the invention. The fabrication of the field emission device includes forming cathode 415 on substrate 414. Cathode 415 can be made by vapor deposition of a metal. After the formation of cathode 415, a dielectric material is deposited upon cathode 415 to provide dielectric layer 418. Dielectric layer 418 is made from a dielectric material, such as silicon dioxide, silicon nitride, and the like, and is deposited using a convenient deposition technique.

After the step of depositing the dielectric material, gate electrode 422 is formed on dielectric layer 418. Gate electrode 422 can be made by vapor deposition of a metal, such as molybdenum, aluminum, and the like.

Figure 8:
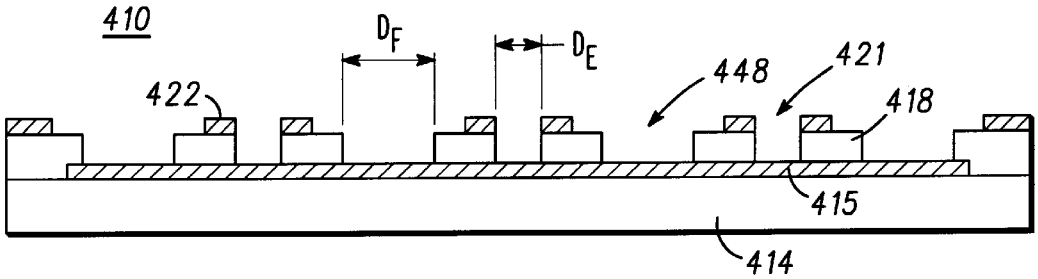
FIGS. 8–11 are cross-sectional views of a cathode plate of a field emission device fabricated in accordance with the method of the invention.

Thereafter, emitter wells 421 and focusing wells 448 are formed in dielectric layer 418. Emitter wells 421 and focusing wells 448 are formed by using convenient etching and patterning techniques. In the example of FIG. 8, a diameter, $D_E$, of each of emitter wells 421 is made smaller than the diameter, $D_F$, of each of focusing wells 448. Furthermore, diameters $D_E$ and $D_F$ are selected so that, during the subsequent step of depositing a lift-off layer, the lift-off material is not deposited onto either a bottom surface 476 of focusing well 448 or a bottom surface 474 of emitter well 421.

Figure 9:
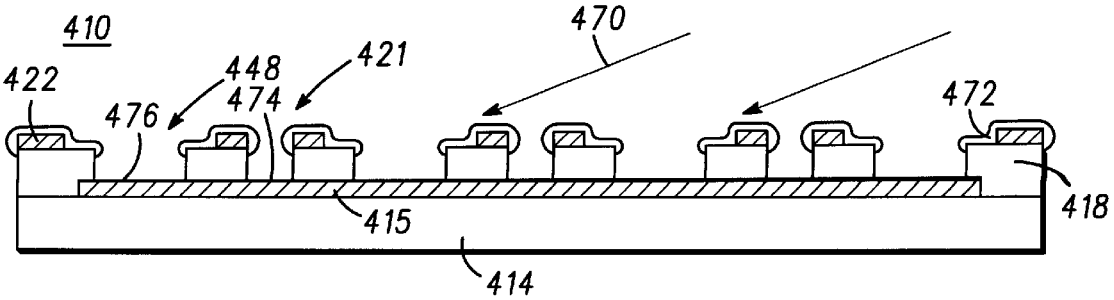

After the step of patterning dielectric layer 418, and as illustrated in FIG. 9, a lift-off layer 472 is formed on gate electrode 422. In the particular example of FIG. 9, lift-off layer 472 is a thin layer of aluminum, which is deposited using a low-angle vapor deposition technique, as indicated by arrows 470 in FIG. 9.

The low-angle vapor deposition technique includes the introduction of gaseous aluminum at a deposition angle with respect to a plane defined by dielectric layer 418. The deposition angle is selected to prevent deposition of the lift-off material, which is represented by arrows 470 in FIG. 9, onto bottom surfaces 474 and 476 of emitter wells 421 and focusing wells 448, respectively. During the deposition of the lift-off material, substrate 414 in rotated about a central axis, which is perpendicular to substrate 414.

Given the deposition angle of the low-angle vapor deposition, the dimensions of focusing wells 448 are selected to preclude the formation of a lift-off coating at bottom surfaces 476 of focusing wells 448. In the example of FIG. 9, the opening of focusing wells 448 is circular. The diameter of the opening has an upper limit, above which deposition at bottom surfaces 476 occurs. Thus, the diameter of focusing wells 448 is selected to be below this upper limit. Deposition at bottom surfaces 476 can also be prevented by manipulation of the depth of focusing wells 448.

Figure 10:
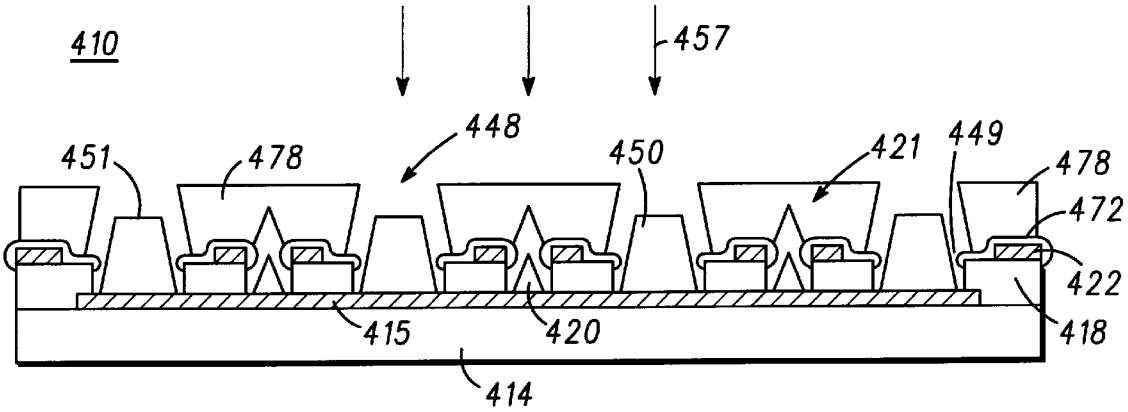

Subsequent to the formation of lift-off layer 472, and as illustrated in FIG. 10, a first collimated vapor beam 457 of an emissive material is directed into emitter wells 421 and focusing wells 448. In general, first collimated vapor beam 457 includes the material or sequence of materials from which electron emitters 420 are made. This step is performed until an encapsulating layer 478 covers emitters wells 421, as shown in FIG. 10.

In accordance with the invention, the opening of the focusing well is larger than the opening of the emitter well. In the particular embodiment of FIG. 10, the diameter of focusing well 448 is greater than the diameter of emitter well 421. Furthermore, because the opening of focusing well 448 is circular, focusing structure 450 becomes generally conically-shaped. However, the scope of the invention is not limited to circular openings. Other shapes can be employed, such as ovular, rectangular, and the like. These other shapes necessarily yield geometries other than conical.

Due to the collimated nature of the vapor deposition, the size of openings, which are defined by encapsulating layer 478 and which overlie emitter wells 421 and focusing wells 448, are progressively reduced during the course of the deposition. Because the diameter of focusing well 448 is greater than the diameter of emitter well 421, the opening defined by encapsulating layer 478, which overlies emitter well 421, becomes closed off before the opening that overlies focusing well 448 becomes closed off.

Depicted in FIG. 10 is the situation wherein the opening overlying each of emitter wells 421 has become closed off, while the opening above each of focusing wells 448 is not closed off. Further depicted in FIG. 10 is the configuration wherein electron emitter 420 is encapsulated.

In the example of FIG. 10, the formation of focusing structures 450 further includes the step of continuing the collimated vapor deposition of the emissive material, subsequent to the encapsulation of electron emitters 420. That is, the deposition of the emissive material is continued until focusing structures 450 are realized. For example, the deposition is continued until the desired height of focusing structures 450 is achieved. During the collimated vapor deposition, gaps 449 are formed within focusing wells 448. Gaps 449 are defined by dielectric layer 418 and focusing structures 450.

Preferably, the collimated vapor deposition is terminated prior to the encapsulation of focusing structures 450 by encapsulating layer 478. In this manner, a sharp, central tip is not formed at apex 451 of focusing structure 450, thereby reducing electron emission from focusing structure 450 during the operation of FED 400.

However, a focusing structure embodying the invention can have a sharp, central tip. If the focusing structure has a sharp, central tip, the height of the focusing structure can be further selected, so that the tip is sufficiently spaced apart from the gate extraction electrode to prevent emission from the tip.

Preferably, focusing structures in accordance with the invention are non-emissive. To reduce electron emission, the focusing structures preferably do not have sharp geometric features, such as sharp points and edges. One method of providing focusing structures 450, which do not have sharp geometric features, includes, subsequent to the step of terminating the collimated vapor deposition, the step of removing sharp features by using a convenient removal technique, such as partial chemical etching, abrading, and the like. Removal of sharp geometric features results in apex 451 being rounded. Most preferably, the step of removing sharp geometric features is performed prior to the removal of encapsulating layer 478. In this manner, electron emitters 420 are protected, so that the sharp tips of electron emitters 420 are not also removed. Subsequent to the formation of focusing structures 450, lift-off layer 472 is removed by using an etching agent, which selectively etches lift-off layer 472.

Figure 11:
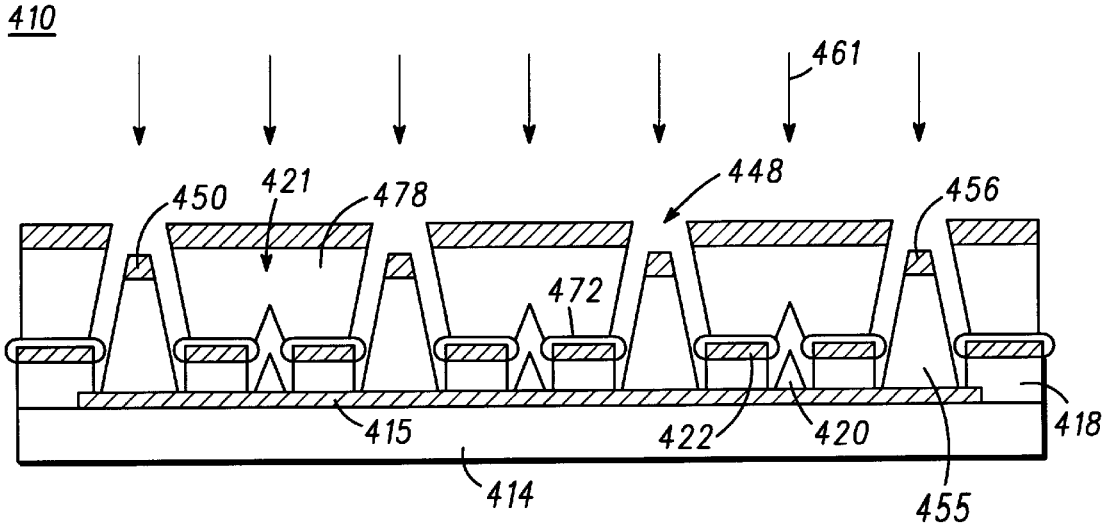

FIG. 11 is a cross-sectional view of cathode plate 410 of a field emission device fabricated in accordance with another embodiment of the invention. In the embodiment of FIG. 11, gate electrode 422 coats the entirety of the upper surfaces of dielectric layer 418. In the fabrication of the field emission device, gate electrode 422 is utilized to deposit lift-off layer 472 by using an electroplating technique.

Subsequent to the formation of gate electrode 422, a conductive material, such as chromium, iron-nickel alloy, and the like, is electroplated onto gate electrode 422, to form lift-off layer 472. The step of electroplating includes the steps of applying a potential to gate electrode 422 and thereafter introducing a plating solution, which includes the conductive material. The potential applied to gate electrode 422 is selected to cause plating onto gate electrode 422 of the conductive material.

The example of FIG. 11 provides the benefit of allowing formation of focusing wells 448, which have larger openings than those of the example of FIG. 9. That is, the restriction on the size of the opening, which is imposed by the low-angle vapor deposition technique, as described with reference to FIG. 9, is not a restriction in the electroplating example of FIG. 11. In this manner, larger focusing structures than those formed via the low-angle vapor deposition technique can be made.

Subsequent to the formation of lift-off layer 472, first collimated vapor beam 457 (not shown) of an emissive material is directed into emitter wells 421 and focusing wells 448 to form electron emitters 420 and the lower portion of focusing structures 450. During this step, encapsulating layer 478 is also formed.

In the example of FIG. 11, first collimated vapor beam 457 (not shown) is continued for some time after the encapsulation of electron emitters 420, so that focusing structures 450 are made from the emissive material over a height that is greater than the height of electron emitters 420. In this manner, first layer 455 is formed.

Thereafter, a second collimated vapor beam 461, as illustrated in FIG. 11, is directed toward focusing wells 448. Second collimated vapor beam 461 is a second material, which is preferably less emissive than the emissive material of first layer 455. Second collimated vapor beam 461 is used to form second layer 456. Thereafter, lift-off layer 472 is selectively etched, to remove encapsulating layer 478. If it is desired to form an array of gate electrodes, the layer of gate electrode 422 is patterned in order to form selectively addressable rows.

In summary, the invention is for an FED having a focusing structure disposed within a focusing well adjacent to an electron emitter. The focusing structure of the invention extends from the bottom of the focusing well to a height greater than the height of the electron emitter. Because the focusing structure of the invention is made during the step for making the electron emitter, its manufacture does not necessitate additional process steps. Furthermore, the focusing structure of the invention can be used to enhance color purity in a color field emission display. The focusing structure of the invention provides electron beam focusing for use with a single-anode FED configuration. In this manner, high voltage anode operation is facilitated.

While we have shown and described specific embodiments of the present invention, further modifications and improvements will occur to those skilled in the art. For example, focusing structures can be configured about the entire periphery of a sub-pixel of a given pixel. They can also be used in an FED having a multiple-anode configuration. Furthermore, while the drawings illustrate a polychromatic field emission display, the invention can be embodied by other types of field emission devices, such as a monochromatic field emission display, a switch, a digital-to-analog signal conversion device, and the like. We desire it to be understood, therefore, that this invention is not limited to the particular forms shown and we intend in the appended claims to cover all modifications that do not depart from the spirit and scope of this invention.

What is claimed:

1. A field emission device comprising:

a substrate;

a dielectric layer disposed on the substrate and defining an emitter well and further defining a focusing well;

an electron emitter disposed within the emitter well; and a conically-shaped focusing structure disposed within the focusing well, whereby the focusing structure focuses an electron beam emitted by the electron emitter.

2. The field emission device as claimed in claim 1, wherein the electron emitter is made from an emissive material, and wherein the focusing structure is made from the emissive material of the electron emitter.

3. The field emission device as claimed in claim 2, wherein the emissive material comprises molybdenum.

4. The field emission device as claimed in claim 1, wherein the focusing structure has an apex, and wherein the apex of the focusing structure is rounded.

5. The field emission device as claimed in claim 1, wherein the focusing structure extends a distance above the electron emitter.

6. The field emission device as claimed in claim 5, wherein the distance above the electron emitter is at least 0.5 micrometers.

7. The field emission device as claimed in claim 1, further comprising a gate electrode disposed on the dielectric layer, and wherein the focusing structure extends a distance above the gate electrode.

8. The field emission device) as claimed in claim 7, wherein the distance above the gate electrode is at least 0.5 micrometers.

9. The field emission device as claimed in claim 8, wherein the distance above the gate electrode is within a range of 0.5–5 micrometers.

10. The field emission device as claimed in claim 1, further comprising a cathode disposed on the substrate, and wherein the electron emitter and the focusing structure are connected to the cathode.

11. The field emission device as claimed in claim 1, further comprising a gate electrode disposed on the dielectric layer, and wherein the gate electrode is spaced apart from the focusing well to define a dielectric surface therebetween.

12. The field emission device as claimed in claim 1, wherein the focusing well has an opening, wherein the emitter well has an opening, and wherein the opening of the focusing well is larger than the opening of the emitter well.

13. The field emission device as claimed in claim 1, wherein the focusing structure comprises a plurality of layers.

14. The field emission device as claimed in claim 1, wherein the focusing structure comprises a first layer at least partially disposed within the focusing well and a second layer disposed on the first layer, wherein the first layer is made from the emissive material of the electron emitter and the second layer is made from a second material, and wherein the second material is less emissive than the emissive material of the electron emitter.

15. A field emission display comprising:

a substrate;

a cathode disposed on the substrate;

a dielectric layer disposed on the cathode and defining an emitter well and further defining a focusing well;

an electron emitter disposed within the emitter well and connected to the cathode;

a conically-shaped focusing structure disposed within the focusing well;

a transparent substrate;

an anode disposed on the transparent substrate; and a phosphor disposed on the anode and disposed to receive an electron beam emitted by the electron emitter, whereby the focusing structure focuses the electron beam emitted by the electron emitter.

16. The field emission display as claimed in claim 15, wherein the electron emitter is made from an emissive material, and wherein the focusing structure is made from the emissive material of the electron emitter.

17. The field emission display as claimed in claim 16, wherein the emissive material comprises molybdenum.

18. The field emission display as claimed in claim 15, wherein the focusing structure has an apex, and wherein the apex of the focusing structure is rounded.

19. The field emission display as claimed in claim 15, wherein the focusing structure extends a distance above the electron emitter.

20. The field emission display as claimed in claim 19, wherein the distance above the electron emitter is at least 0.5 micrometers.

21. The field emission display as claimed in claim 15, further comprising a gate electrode disposed on the dielectric layer, and wherein the focusing structure extends a distance above the gate electrode.

22. The field emission display as claimed in claim 21, wherein the distance above the gate electrode is at least 0.5 micrometers.

23. The field emission display as claimed in claim 22, wherein the distance above the gate electrode is within a range of 0.5–5 micrometers.

24. The field emission display as claimed in claim 15, further comprising a cathode disposed on the substrate, and wherein the electron emitter and the focusing structure are connected to the cathode.

25. The field emission display as claimed in claim 15, further comprising a gate electrode disposed on the dielectric layer, and wherein the gate electrode is spaced apart from the focusing well to define a dielectric surface therebetween.

26. The field emission display as claimed in claim 15, wherein the focusing well has an opening, wherein the emitter well has an opening, and wherein the opening of the focusing well is larger than the opening of the emitter well.

27. The field emission display as claimed in claim 15, wherein the focusing structure comprises a plurality of layers.

28. The field emission display as claimed in claim 15, wherein the focusing structure comprises a first layer at least partially disposed within the focusing well and a second layer disposed on the first layer, wherein the first layer is made from the emissive material of the electron emitter and the second layer is made from a second material, and wherein the second material is less emissive than the emissive material of the electron emitter.

* * * * *